US010035670B2

(12) United States Patent
Yoshida et al.

(10) Patent No.: US 10,035,670 B2
(45) Date of Patent: Jul. 31, 2018

(54) SHEET STORING APPARATUS, SHEET FEEDING APPARATUS, AND IMAGE FORMING APPARATUS

(71) Applicant: CANON KABUSHIKI KAISHA, Tokyo (JP)

(72) Inventors: Masatoshi Yoshida, Susono (JP); Takao Nada, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/404,529

(22) Filed: Jan. 12, 2017

(65) Prior Publication Data

US 2017/0217698 A1 Aug. 3, 2017

(30) Foreign Application Priority Data

Jan. 28, 2016 (JP) ..... 2016-014409

(51) Int. Cl.
*B65H 1/04* (2006.01)
*B65H 1/26* (2006.01)

(52) U.S. Cl.
CPC ..... *B65H 1/04* (2013.01); *B65H 1/266* (2013.01)

(58) Field of Classification Search
CPC ... B65H 1/04; B65H 3/66; B65H 3/68; B65H 2405/1142; B65H 2405/11425
See application file for complete search history.

(56) References Cited

U.S. PATENT DOCUMENTS

| | | | | |
|---|---|---|---|---|
| 5,921,690 | A | 7/1999 | Shinmachi et al. | |
| 6,027,269 | A | 2/2000 | Yoshida | |
| 8,430,392 | B2 | 4/2013 | Nada et al. | |
| 8,668,198 | B2 | 3/2014 | Tsuji et al. | |
| 9,146,520 | B2 | 9/2015 | Fuse et al. | |
| 9,260,262 | B2 * | 2/2016 | Matsumoto | B65H 1/266 |
| 9,446,923 | B2 | 9/2016 | Yoshida et al. | |
| 2013/0214483 | A1 * | 8/2013 | Hirahara | B65H 1/00 271/264 |

(Continued)

FOREIGN PATENT DOCUMENTS

| | | | |
|---|---|---|---|
| JP | 5-306024 | A | 11/1993 |
| JP | 2001-88970 | A | 4/2001 |
| JP | 2008-195469 | A | 8/2008 |

(Continued)

*Primary Examiner* — David H Bollinger
(74) *Attorney, Agent, or Firm* — Fitzpatrick, Cella, Harper & Scinto

(57) ABSTRACT

A sheet regulating portion includes a body portion including a regulating surface facing an edge of a sheet, a pressing member having a pressing portion capable of projecting out of the body portion, an upper portion formed integrally with an upper part of the pressing portion so as to project to a sheet side and regulating an upward move of the sheet, and an urging member to urge the pressing member so that the pressing portion presses the edge of the sheet. In addition, a holding portion holds the pressing portion movably from a projecting position where the pressing portion projects out of the body portion to a retracting position where the upper portion enters within the body portion while inclining the pressing portion with respect to the regulating surface by resisting against the urging member when the upper portion is pressed from above.

15 Claims, 11 Drawing Sheets

(56) References Cited

U.S. PATENT DOCUMENTS

| | | | | |
|---|---|---|---|---|
| 2016/0289017 | A1 | 10/2016 | Yoshida et al. | |
| 2017/0015512 | A1* | 1/2017 | Kawazoe ..... | B65H 3/34 |

FOREIGN PATENT DOCUMENTS

| | | | |
|---|---|---|---|
| JP | 2011-57450 | A | 3/2011 |
| JP | 2011-152993 | A | 8/2011 |
| JP | 2015-110464 | A | 6/2015 |

* cited by examiner

SHEET STORING APPARATUS, SHEET FEEDING APPARATUS, AND IMAGE FORMING APPARATUS

BACKGROUND OF THE INVENTION

Field of the Invention

The present invention relates to a sheet storing apparatus, a sheet feeding apparatus, and an image forming apparatus.

Description of the Related Art

An image forming apparatus such as a copier, a printer, and a facsimile machine of a sort of feeding a sheet to an image forming unit from a sheet feeding apparatus to form an image on the sheet is being widely used today. In general, the sheet feeding apparatus includes a sheet feed cassette, i.e., a sheet storing apparatus, removably attached to an apparatus body and feeding the sheet stored in the sheet feed cassette to the image forming unit by a sheet feed roller.

Some of the sheet feed cassettes used in the sheet feeding apparatus includes a sheet supporting plate liftably provided to stack a sheet and to press the sheet against a sheet feed roller for example. The sheet feed cassette is provided with a rear end regulating portion configured to regulate a position of a rear end in a sheet feed direction of the sheet (referred to as a 'rear end' hereinafter) stored in the sheet feed cassette which is configured to be able to store different size sheets. The sheet feed cassette is also provided with a pair of side regulating members configured to regulate side end positions in a direction orthogonal to the sheet feed direction (referred to as a 'width direction' hereinafter) of the sheet stored in the sheet feed cassette.

Such sheet feed cassette is configured to regulate the rear end of the sheet by the rear end regulating portion while regulating the side ends of the sheet by the pair of side regulating members to regulate a front end position of the sheet always at a predetermined position. This arrangement makes it possible to feed the sheet from a same position and to feed the sheet stably when the sheet feed cassette is stored in an apparatus body.

In the conventional sheet feed cassette, there is a case when the sheet stacked on the sheet supporting plate floats above an upper end of the side regulating portion when the sheet supporting plate rises. The sheet is conveyed askew if the sheet is fed in this condition. Then, in order to regulate the sheet from floating up as described above, a tab-shaped member is provided at an upper end of a unit body regulating a side end of a sheet to press the sheet from above and to regulate the sheet from getting over the upper end of the unit body as disclosed in Japanese Patent Application Laid-open No. 2011-57450.

As another arrangement, a curl presser portion is turnably attached to a front end of a regulating surface of a regulating member configured to regulate a side end of a sheet to regulate a curled part of the sheet from getting over the upper end of the regulating member by the curl presser portion as disclosed in Japanese Patent Laid-open No. 2001-88970 for example. The curl presser portion presses the curled part at an end of the stacked sheet by being held at a position approximately at a right angle with respect to the regulating surface by an urging member.

By the way, in the case of the arrangement of pressing the sheet by the tab-shaped member, it is necessary to store the sheet while avoiding the tab-shaped member so as not to damage the sheet in storing the sheet because the tab-shaped member is fixed to the unit body. Thus, storability of the sheet deteriorates.

Meanwhile, in the case of the arrangement of pressing the sheet by the curl presser portion, the storability of the sheet does not deteriorate in storing the sheet because the curl presser portion turns downward by resisting against an urging force of the urging member by being pressed from above by the stored sheet. However, this arrangement requires a plurality of components, thus leading to an increase of cost and to deterioration of assemblability.

SUMMARY OF THE INVENTION

According to a first aspect of the invention, a sheet feeding apparatus includes a sheet feed portion configured to feed a sheet and a sheet storing apparatus configured to store the sheet to be fed by the sheet feed portion and including a side regulating portion configured to regulate a position of the sheet by abutting with a side end of the sheet stored in the sheet storing apparatus. The side regulating portion includes a body portion including an inner wall surface facing the sheet, a pressing portion capable of projecting out of the body portion and of pressing the side end of the sheet, a regulating portion formed integrally with an upper part of the pressing portion so as to project to a sheet side and regulating an upward move of the sheet stored in the sheet storing apparatus, an urging portion configured to urge the pressing portion such that the pressing portion projects out of the body portion so that the pressing portion presses the side end of the sheet, and a holding portion configured to hold the pressing portion movably from a project position where the pressing portion projects out of the body portion to a retract position where the regulating portion enters within the body portion by resisting against the urging member when the regulating portion is pressed from above.

According to a second aspect of the invention, a sheet storing apparatus includes a body configured to store a sheet, and a side regulating portion configured to abut against a side end of the stored sheet to regulate a position of the sheet. The side regulating portion includes a body portion including a regulating surface facing the side end of the sheet to regulate the side end of the sheet, a pressing member comprising a pressing portion projectable/retractable from the body portion and capable of pressing the side end of the sheet, and a regulating portion formed integrally with an upper part of the pressing portion so as to project to a widthwise inner side and regulating an upward move of the sheet stored in the sheet storing apparatus, an urging member configured to urge the pressing member such that the pressing member projects out of the body portion so that the pressing portion presses the side end of the sheet, and a holding portion configured to hold the pressing member movably from a project position where the pressing member projects out of the body portion to a retract position where the regulating portion enters within the body portion by resisting against the urging member when the regulating portion is pressed from above.

Further features of the present invention will become apparent from the following description of exemplary embodiments with reference to the attached drawings.

DESCRIPTION OF THE EMBODIMENTS

Figure 1:
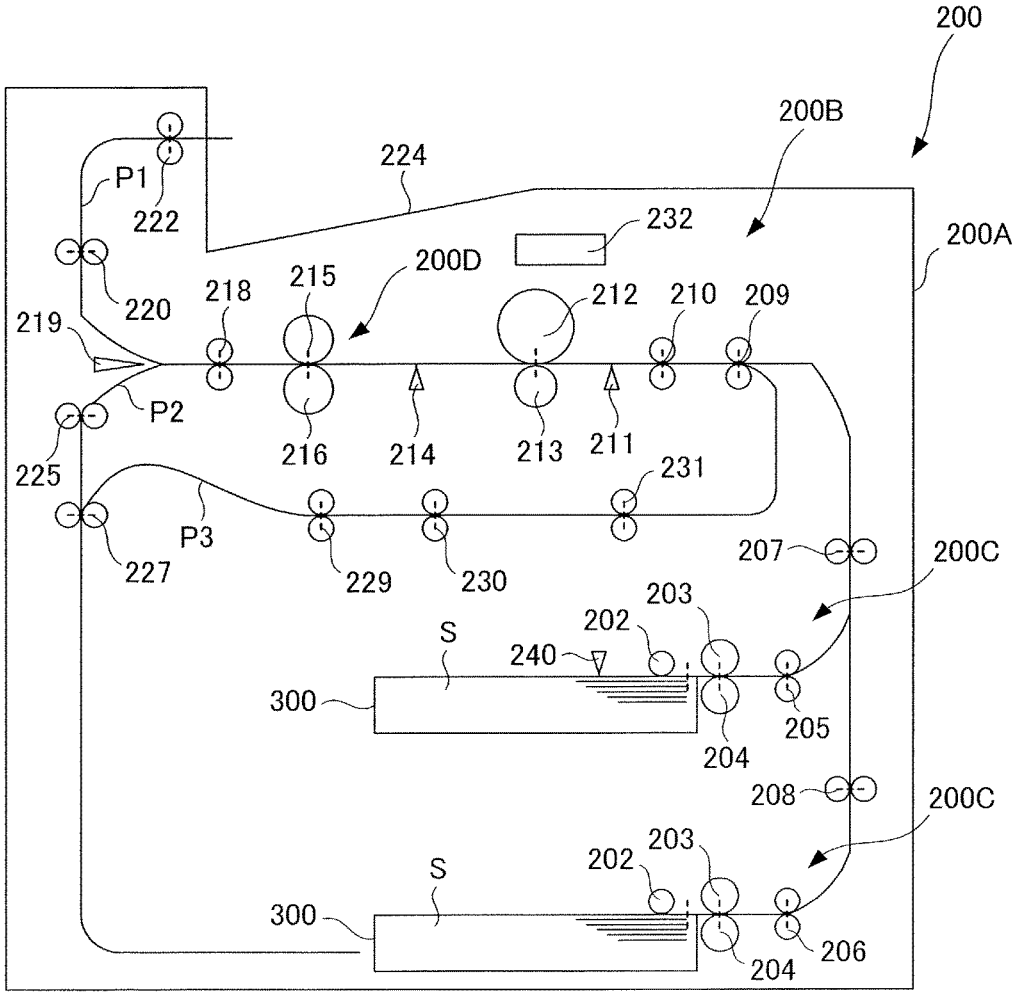
FIG. 1 is a schematic diagram illustrating a configuration of an image forming apparatus including a sheet feeding apparatus of a first embodiment of the invention.

Embodiments of the present disclosure will be described in detail below with reference to the drawings. FIG. 1 is a schematic diagram illustrating a configuration of an image forming apparatus including a sheet feeding apparatus of a first embodiment. As illustrated in FIG. 1, the image forming apparatus 200 includes an image forming unit 200B provided in an upper part of a body 200A of the image forming apparatus 200 and configured to electro-photographically form an image on a sheet. The image forming apparatus 200 also includes a sheet feeding apparatus 200C provided in a lower part of the image forming apparatus body 200A and configured to feed the sheet to the image forming unit 200B.

The image forming unit 200B is provided with a photosensitive drum 212, a laser scanner 232, and others. The sheet feeding apparatus 200C is provided with a sheet feed cassette 300 serving as a sheet storing apparatus storing the sheet S and a pickup roller 202 serving as a sheet feed portion feeding the sheet stored in the sheet feed cassette 300.

In response to a feed signal outputted from a controller not illustrated to the sheet feeding apparatus 200C in the image forming apparatus 200 constructed as described above, the sheet S is fed by the pickup roller 202 from the sheet feed cassette 300. After that, the sheet S fed as described above is separated one by one by a feed roller 203 and a retard roller 204 and is conveyed to a pre-registration roller pair 209 and a registration roller pair 210 through upper drawing roller pairs 205 and 206 and upper conveyance roller pairs 207 and 208. While there is a case when the sheet S is conveyed askew by being affected by a conveyance load, variation of precision of components or the like in the process being conveyed to the pre-registration roller pair 209, the skew is removed by a holding force and a registration shutter mechanism not illustrated of the registration roller pair 210. After that, a top sensor 211 detects the sheet S whose skew has been corrected.

Meanwhile, based on a signal from the top sensor 211, the controller irradiates the photosensitive drum 212 with a laser beam corresponding to an image signal from the laser scanner 232. At this time, by being irradiated with the laser beam, the photosensitive drum 212 which has been electrified in advance forms an electrostatic latent image thereon. Then, a toner image is formed on the photosensitive drum 212 by developing the electrostatic latent image by toner.

The toner image is transferred onto a predetermined position on the sheet S when the sheet S is conveyed to a transfer nip portion composed of a transfer roller 213 and the photosensitive drum 212 by conducting the exposure and scanning by utilizing the signal of the top sensor 211. Then, the toner image is transferred onto the sheet S by the transfer roller 213. Thus, a transferred image is formed on the sheet S.

Next, the sheet S onto which the toner image has been transferred is conveyed to a fixing unit 200D including a fixing roller 215 and a pressure roller 216. By undergoing heat and pressure applied in the fixing unit 200D, the toner melts and the transferred image is fixed on the sheet S. Here, when the sheet S is conveyed to the fixing unit 200D and is conveyed by both fixing and transfer nip portions, it is necessary to avoid the image being transferred from being affected by differences of conveying velocities of the photosensitive drum 212, the transfer roller 213, the fixing roller 215 and the pressure roller 216. To that end, the controller gives the sheet S with an adequate amount of sag between the transfer and fixing rollers by controlling the velocity of the pressure roller 216 by utilizing a signal of a loop sensor 214 to control so that the amount is kept always at the adequate amount during when the sheet is conveyed between the transfer roller 213 and the fixing roller 215.

After that, the fixed sheet S is conveyed by a conveyance roller 218 and is lead to a face down (FD) sheet discharge passage P1 by being switched by a switching member 219 in a case of a simplex printing mode. Then, the sheet S is discharged out of the image forming apparatus body 200A through an intermediate sheet discharge roller pair 220 and a face down (FD) sheet discharge roller pair 222 and is stacked on a face down (FD) sheet discharge tray 224. It is noted that the image forming apparatus 200 of the present embodiment has a duplex printing mode of forming images on both surfaces of the sheet.

In the case of the duplex printing mode, the sheet S which has passed through the fixing unit 200D is lead to a branch passage P2 by being switched by the switching member 219 at first. Then, the sheet S is conveyed by a conveyance roller 225 to a reversing roller 227 and to a duplex printing passage P3 by reverse rotation of the reversing roller 227 and switching made by a switching member not illustrated. After that, the sheet S is conveyed to the pre-registration roller pair 209 again by conveyance rollers 229, 230, and 231 provided along the duplex printing passage P3 to transfer and fix a toner image again onto another side of the sheet S. Then, the sheet S is discharged by the intermediate sheet discharge roller pair 220 and the FD discharge roller pair 222.

Figure 2:
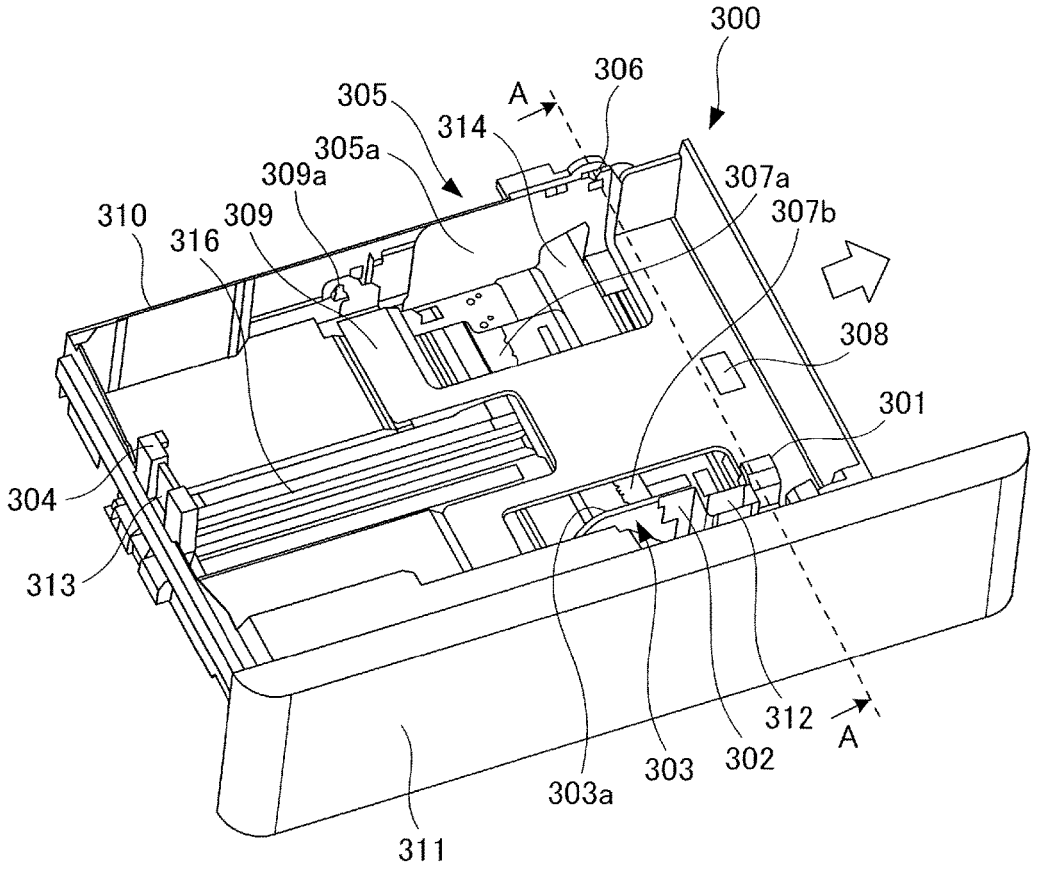
FIG. 2 is a perspective view of a sheet feed cassette provided in the sheet feeding apparatus.

As illustrated in FIG. 2, the sheet feed cassette 300 configured to store a plurality of sheets includes a cassette body 310 having a cassette cover 311 and a sheet supporting plate 309 serving as a sheet stacking portion stacking the sheets and being movable in a vertical direction. The sheet feed cassette 300 also includes a rear end regulating member 304 serving as a rear end regulating portion regulating a rear end position which is an upstream end in the sheet feed direction of the sheet stacked on the sheet supporting plate. The sheet feed cassette 300 also includes first and second side regulating plates 303 and 305 regulating both end positions in the width direction orthogonal to the sheet feed direction of the sheet stacked on the sheet supporting plate. The second side regulating plates 303 and 305 serves as a side regulating portions (regulating unit).

The sheet supporting plate 309 is provided in the cassette body 310 turnably in the vertical direction centering on a turning center 309*a* and is provided with a separation sheet 308 pasted at a front end part on a downstream end side in the sheet feed direction of an upper surface thereof. The sheet supporting plate 309 is provided with a push-up plate 314 for pushing up the sheet supporting plate 309 under the sheet supporting plate 309.

It is noted that the image forming apparatus body 200A is provided with a lift mechanism not illustrated for turning the sheet supporting plate 309 upward by driving the push-up plate 314. Then, in response to a timing when a user inserts the sheet feed cassette 300 into the image forming apparatus body 200A after storing sheets in the sheet feed cassette 300, a drive of the lift mechanism is transmitted to the push-up plate 314 so that the push-up plate 314 turns upward and the sheet supporting plate 309 turns upward by being pressed by the push-up plate 314. Thereby, the sheet on the sheet supporting plate is pressed against the pickup roller 202 described and illustrated in FIG. 1 disposed approximately above the separation sheet 308. When the pickup roller 202 turns in this condition, the sheet is conveyed in a direction of an arrow in FIG. 2.

The rear end regulating member 304 moves in the sheet feed direction along a guide portion 316 provided along the sheet feed direction on a bottom surface of the cassette body 310. The rear end regulating member 304 also includes a rear end regulation manipulating lever 313 that can be engaged/disengaged to the guide portion 316. The engagement with the guide portion 316 is released by pinching the rear end regulation manipulating lever 313. After that, the rear end regulating member 304 moves by moving the rear end regulation manipulating lever 313 along the sheet feed direction while pinching the rear end regulation manipulating lever 313.

The first and second side regulating plates 303 and 305 are provided with body portions 303*a* and 305*a* having inner wall surfaces respectively facing widthwise end portions of the sheet. It is noted that the inner wall surface may be also called as a regulating surface for regulating the side end of the sheet. The first and second side regulating plates 303 and 305 are attached with racks 307*a* and 307*b* extending respectively in the width direction. The racks 307*a* and 307*b* are meshed with a pinion gear not illustrated and located at a widthwise center part on the bottom surface of the cassette body 310.

The first side regulating plate 303 also includes a side regulation manipulating lever 312 disengageably engaging with a lock portion not illustrated provided along the width direction on the bottom surface of the cassette body 310. The engagement with the lock portion not illustrated is released by pinching the side regulation manipulating lever 312. After that, the first and second side regulating plates 303 and 305 move in the width direction symmetrically centering on the pinion gear by moving the side regulation manipulating lever 312 along the width direction while pinching the side regulation manipulating lever 312.

Sheets of various sizes can be stored in the sheet feed cassette 300 by movably providing the rear end regulating member 304 and the first and second side regulating plates 303 and 305. The sheet can be positioned in setting the sheet by moving the rear end regulating member 304 and the first and second side regulating plates 303 and 305 to the position corresponding to a sheet size.

Figure 3:
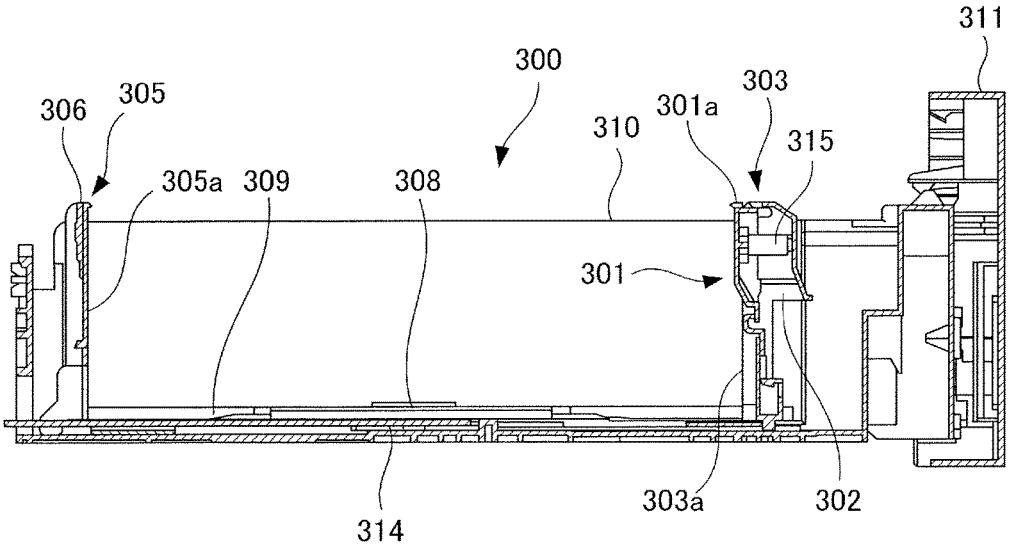
FIG. 3 is a section view of the sheet feed cassette.

Here, as illustrated in FIG. 3, a height regulating portion 306 is provided at an upper end of the second side regulating plate 305 so as to project toward a sheet side from the body portion 305*a*. The height regulating portion 306 is provided to prevent a downstream end of the sheet from running on the second side regulating plate 305 when the sheet is fed. That is, the height regulating portion 306 makes it possible to prevent the sheet from skewing by preventing the sheet from riding on the second side regulating plate 305.

The first side regulating plate 303 is provided with a pressing member 301 projectably/retractably from the body portion 303*a*. The pressing member 301 is configured to be held projectably/retractably by a holder member 302 which is a holding portion provided in the first side regulating plate 303 and to be urged projectably from the body portion 303*a* by a urging member 315 provided between the holder member 302 and the pressing member 301. By being pressed by the pressing member 301 urged thus by the urging member 315, the sheet is pressed against the body portion 305*a* of the second side regulating plate 305.

Even if a gap is generated between the sheet stored in the cassette and the first and second side regulating plates 303 and 305, it is possible to press the sheet against the second side regulating plate 305 by thus pressing the sheet against the body portion 305*a* of the second side regulating plate 305. That is, according to the present embodiment, the sheet is pressed against the second side regulating plate 305 to regulate the position of the sheet. Then, the sheet stored in the cassette can be fed from a fixed position by making the second side regulating plate 305 as a standard in feeding the sheet.

Figure 4:
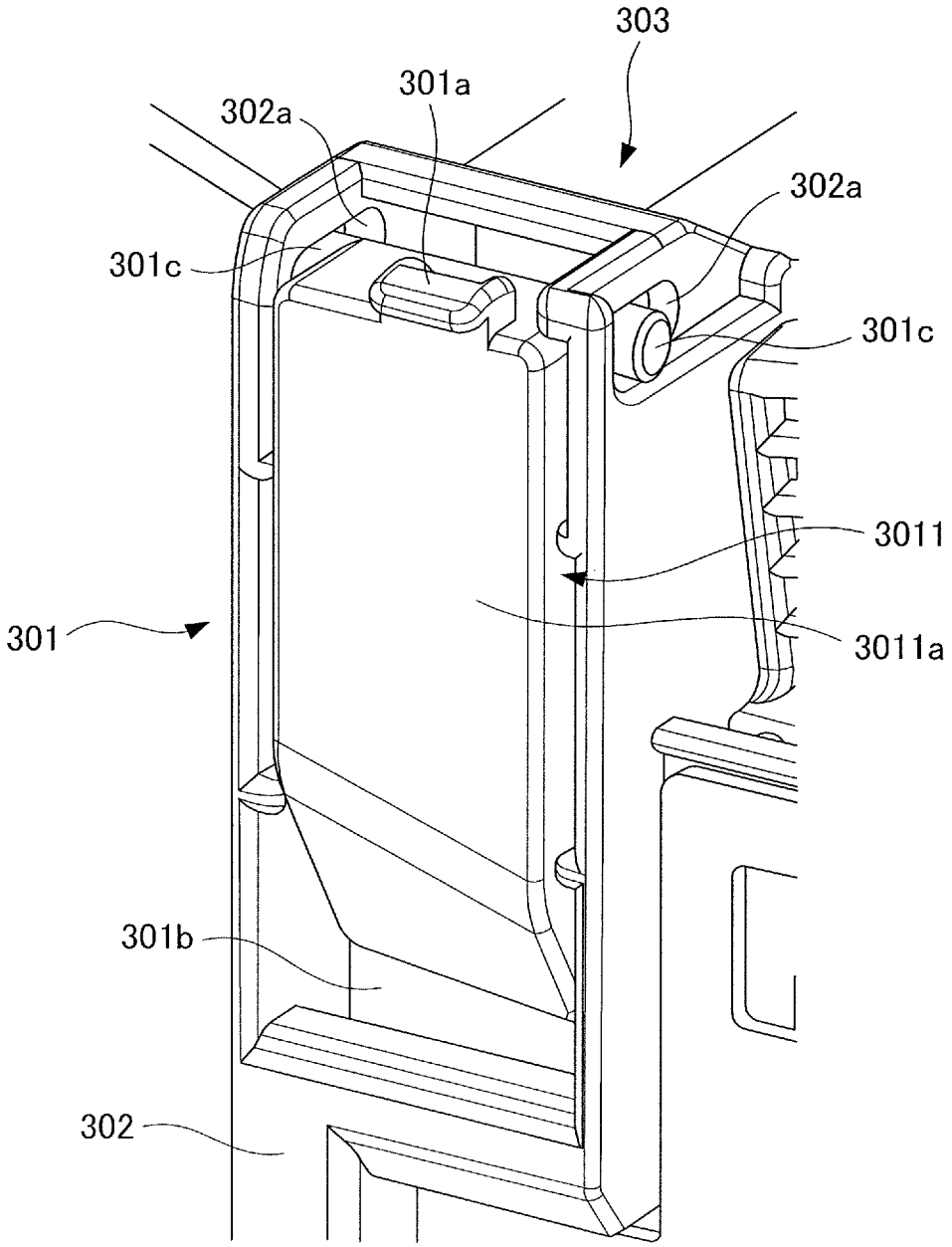
FIG. 4 is an enlarged perspective view of a main part of a first side regulating plate of the sheet feed cassette.

As illustrated in FIG. 4, the pressing member 301 includes a pressing body portion 3011 having an abutment surface 3011*a* abutting with the sheet and serving as a pressing portion capable of pressing the side end of the sheet. The pressing member 301 includes a height regulating portion 301*a* serving as a regulating portion formed at an upper part of the pressing body portion 3011 or integrally with an upper end of the abutment surface 3011*a*, and an abutment portion 301*b* provided at a lower end of the pressing body portion 3011. The pressing member 301 includes bosses 301*c* which serve as supported portions and are shafts projectively provided on both widthwise wall surfaces of the pressing body portion 3011. The height regulating portion 301*a* regulates an upward move of the sheet to prevent the downstream end of the sheet from running on the first side regulating plate 303 and is provided so as to project to the sheet side by a predetermined amount from the abutment surface 3011*a* as described above. It is noted that the bosses 301*c* are located under and widthwise outside of the height regulating portion 301*a*, and the urging member 315 is configured so as to urge the pressing member 301 to widthwise inside under the bosses 301*c* of the pressing member 301.

Long holes 302*a* which are support portions extending respectively in a horizontal direction are defined through opposing widthwise inner wall surfaces of the holder member 302. Then, the pressing member 301 is held by the holder member 302 movably along the long holes 302*a* and turnably centering on the bosses 301*c* by slidably supporting the bosses 301*c* of the pressing member 301 by the long holes 302*a*.

Still further, the holder member 302 is provided with first and second stoppers 302*c* and 302*d* as illustrated in FIGS. 5A through 5D described later. When the pressing member 301 is urged by the urging member 315, the first stopper 302*c* abuts against the abutment portion 301*b* of the pressing member 301 to regulate a project position of the pressing member 301 with respect to the second side regulating plate 305. When the pressing member 301 turns at a fulcrum of the bosses 301*c* by resisting against the urging member 315, the second stopper 302*d* abuts against the abutment portion 301*b* of the pressing member 301 to regulate the turn of the pressing member 301.

Figure 5A:
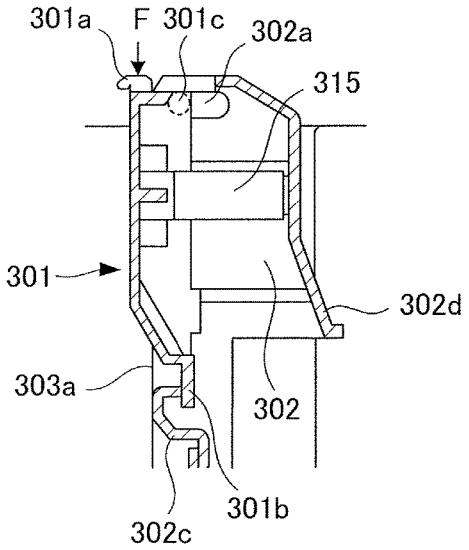
FIG. 5A illustrates a condition of a pressing member of the first side regulating plate before a sheet is stored in the sheet feed cassette.

Next, an operation of the pressing member 301 will be described with reference to FIGS. 5A through 5D. FIG. 5A illustrates a condition before a sheet is stored in the sheet feed cassette 300. At this time, by being urged by the urging member 315, the boss 301*c* of the pressing member 301 abuts against a downstream end, in a direction in which the pressing member 301 projects, of the long hole 302*a* and the abutment portion 301*b* abuts against the first stopper 302*c*.

The user stores the sheet in the sheet feed cassette 300 in this condition. It is noted that the user stores the sheet by operating the side regulation manipulating lever 312 and the rear end regulation manipulating lever 313 in advance corresponding to size of the sheet to move and fix the first and second side regulating plates 303 and 305 and the rear end regulating member 304 at a position corresponding to the size of the sheet. The user stores the sheet from above after that.

Figure 5B:
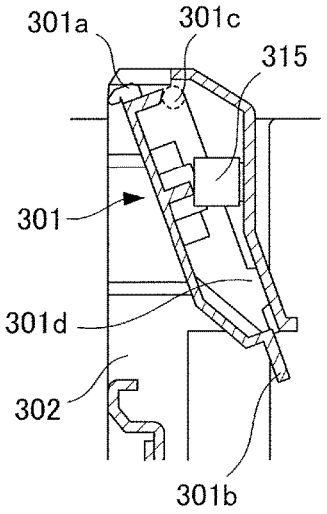
FIG. 5B illustrates a condition of the pressing member when the sheet is stored in the sheet feed cassette.

Here, the height regulating portion 301*a* is provided so as to project by the predetermined amount from the upper end of the abutment surface 3011*a* as described above. Due to that, when the sheet is stored from above, the sheet abuts against the height regulating portion 301*a* and the height regulating portion 301*a* is pressed by a force F from above by the sheet. Due to the force F, the pressing member 301 located at the project position projecting from the body portion 303*a* turns centering on the boss 301*c* as illustrated in FIG. 5B. Then, due to a component of the force F generated thus by the turn, the boss 301*c* moves along the long hole 302*a* to the retract position where the pressing member 301 and the height regulating portion 301*a* enter within a holder member 302 (inside of the body portion).

It is noted that when the height regulating portion 301*a* enters completely within the holder member 302, the first side regulating plate 303 is in flush with the body portion 303*a*. Still further, the abutment portion 301*b* abuts against the second stopper 302*d* of the holder member 302 at this time, so that the pressing member 301 stops.

Thus, it is possible to prevent the height regulating portion 301*a* from deteriorating the storability of the sheet in storing the sheet by arranging such that the pressing member 301 moves in a direction in which the height regulating portion 301*a* retracts while turning by being pressed by the sheet and such that the height regulating portion 301*a* enters within the holder member 302. That is, it is possible to prevent the storability of the sheet from deteriorating by configuring the pressing member 301 so as to be turnable and movable from the project position to the retract position.

Figure 5C:
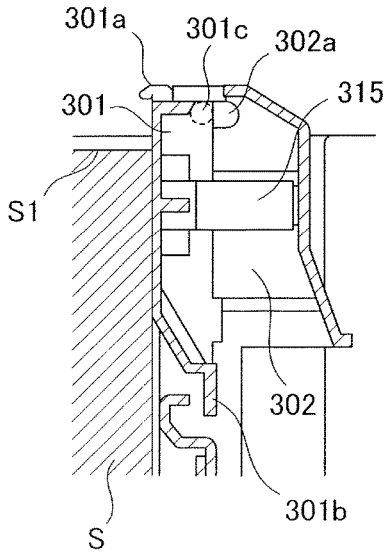
FIG. 5C illustrates a condition of the pressing member when the storage of the sheet is completed.

FIG. 5C illustrates a condition when the storage of the sheet is completed. At this time, no force is applied from above to the pressing member 301 by the sheet, so that only urging force of the urging member 315 acts on the pressing member 301. The pressing member 301 capable of pressing the side end in the width direction of the sheet by the urging force of the urging member 315 presses the side end in the width direction of the sheet with a constant force. As a result, the sheet may be caused to abut against the second side regulating plate 305, and thereby the sheet can be stored at a position corresponding to the size of the sheet.

Figure 5D:
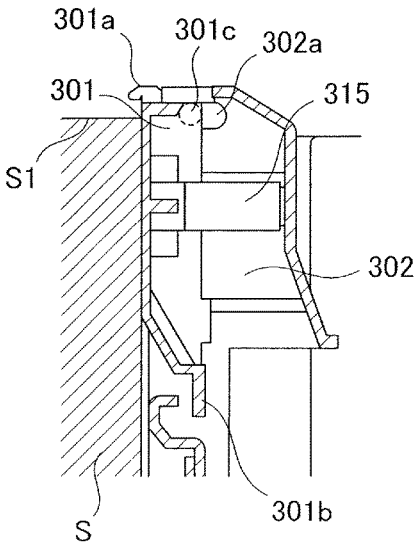
FIG. 5D illustrates a condition of the pressing member when the sheet is pressed against a pickup roller after the sheet feed cassette has been attached to a body of the image forming apparatus.

FIG. 5D illustrates a condition in which the sheet supporting plate 309 rises and the sheet is pressed against the pickup roller after attaching the sheet feed cassette 300 in which the sheet has been stored to the image forming apparatus body 200A. Here, if the height regulating portion 301*a* is in contact with an uppermost sheet S1 when the sheet is pressed against the pickup roller, the pickup roller becomes resistance in feeding the sheet. Due to that, a certain gap is kept between the uppermost sheet S1 and the height regulating portion 301*a* when the sheet is pressed against the pickup roller. Then, when a drive is transmitted from the image forming apparatus body 200A to the pickup roller in this condition, the sheet is fed out of the sheet feed cassette 300 without receiving any resistance from the height regulating portion 301*a*.

As described above, according to the present embodiment, the height regulating portion 301*a* is integrally formed with the pressing member 301 and the pressing member 301 is provided turnably with respect to the first side regulating plate 303 and movably to the project and retract positions. Thereby, when the sheet abuts with the height regulating portion 301*a* when the sheet is stored in the sheet feed cassette 300 and the height regulating portion 301*a* is pressed from above by the sheet, the pressing member 301 turns and moves to the retract position. Then, because the pressing member 301 thus turns and moves to the retract position, it is possible to store the sheet while setting the first and second side regulating plates 303 and 305 at a position corresponding to size of the sheet. Thus, this arrangement makes it possible to prevent the storability of the sheet from being deteriorated also in such a case.

Still further, because the height regulating portion 301*a* moves to the position in flush with the body portion 303*a* of the first side regulating plate 303 in maximum in storing the sheet, it is possible to prevent an edge of the sheet from being damaged by the height regulating portion 301*a* in storing the sheet. Still further, the pressing member 301 is configured such that the pressing member 301 retracts while turning by receiving the force from the sheet. In other words, the holder member 302 holds the pressing body portion 3011 movably from the project position to the retract position while inclining with respect to the regulating surface. This arrangement makes it possible to move the pressing member 301 to the retract position even if the force applied to the pressing member 301 is small.

This arrangement makes it possible to move the pressing member 301 to the retract position even if the position where the sheet is set varies and the force applied to the pressing member 301 becomes small. As a result, it becomes unnecessary to provide a tapered height regulating portion by considering the variation of the position where the sheet is set. Accordingly, it is possible to prevent the height regulating portion from being enlarged in width and height directions and along with that, to downsize the first side regulating plate 303 and the sheet feed cassette 300.

Figure 6:
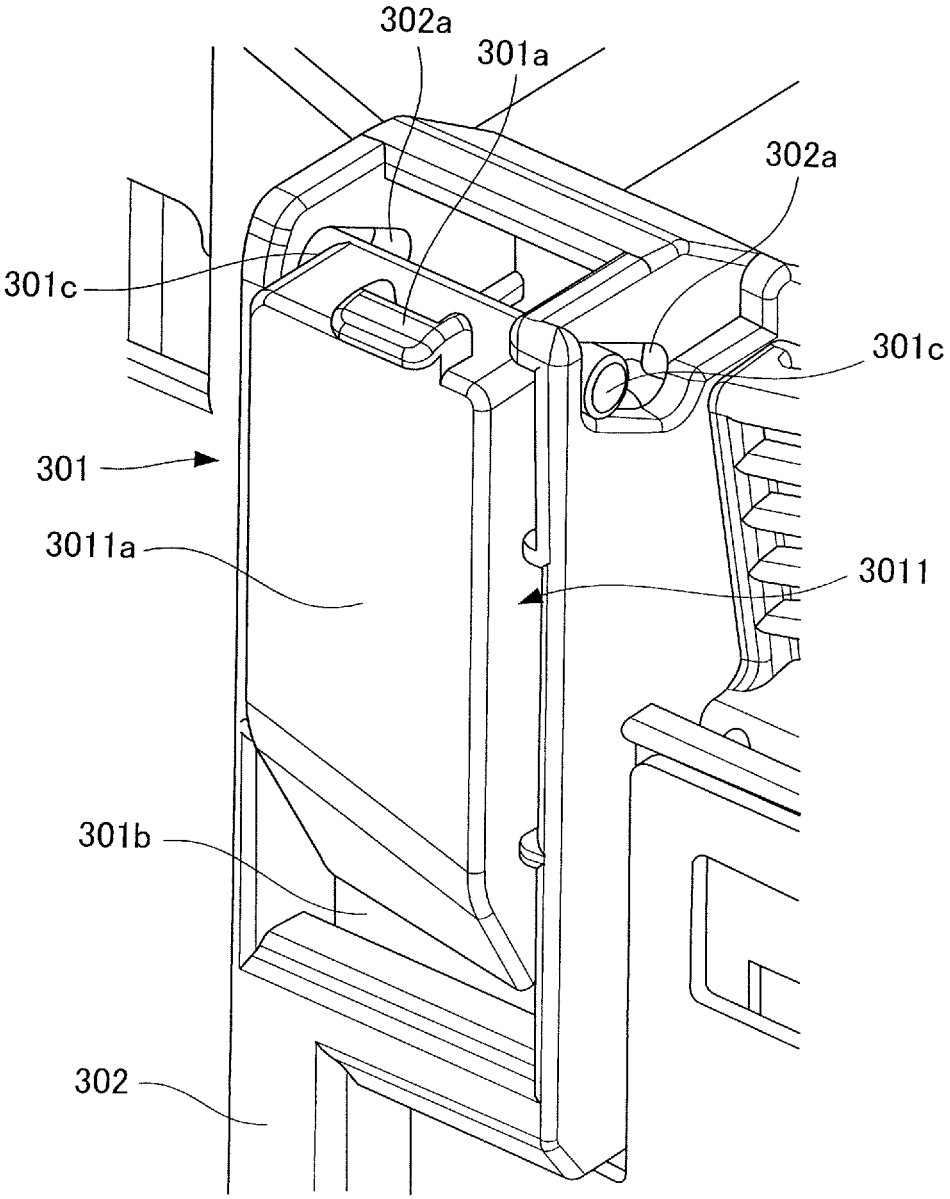
FIG. 6 is an enlarged perspective view of a main part of a first side regulating plate provided in the sheet feed cassette of the sheet feeding apparatus of a second embodiment.

Next, a second embodiment of the present disclosure will be described. FIG. 6 is an enlarged perspective view of a main part of a first side regulating plate provided in the sheet feed cassette of the sheet feeding apparatus of the present embodiment. It is noted that in FIG. 6, the same reference numerals with those described in FIG. 4 denote the same or corresponding components.

According to the present embodiment, the long holes 302*a* of the holder member 302 are inclined obliquely downward such that a downstream side thereof in the retract direction is lowered as illustrated in FIG. 6. In other words, according to the present embodiment, the long holes 302*a* are inclined such that a height position of the pressing member 301 is lowered when the pressing member 301 moves to the retract position.

Figure 7A:
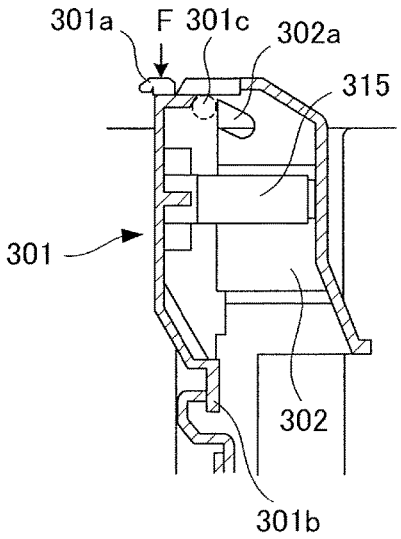
FIG. 7A illustrates a condition of a pressing member of the first side regulating plate before a sheet is stored in the sheet feed cassette.
Figure 7B:
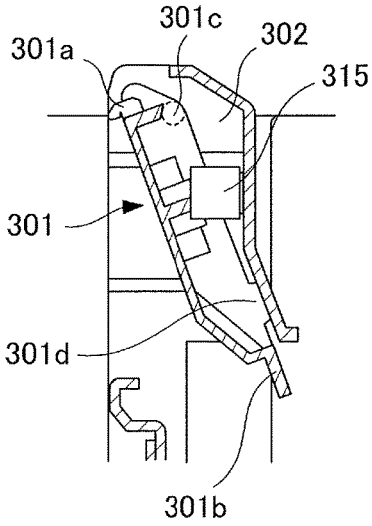
FIG. 7B illustrates a condition of the pressing member when the sheet is stored in the sheet feed cassette.

Thereby, when the height regulating portion 301*a* illustrated in FIG. 7A receives a force F from a sheet, the pressing member 301 turns centering on the boss 301*c* and moves obliquely downward along the long holes 302*a* by a component of the force F as illustrated in FIG. 7B. Then, the pressing member 301 enters within the holder member and moves to the retract position where the height regulating portion 301*a* is flush with the body portion 303*a* of the first side regulating plate 303.

Figure 7C:
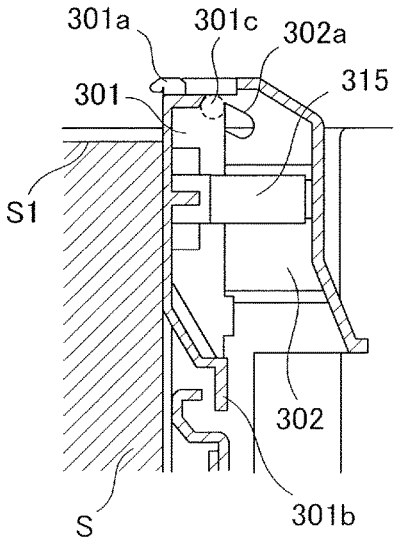
FIG. 7C illustrates a condition of the pressing member when the storage of the sheet is completed.

After that, when the storage of the sheet is completed, no force is applied to the pressing member 301 from above by the sheet. Then, the pressing member 301 moves obliquely upward by the urging force of the urging member 315 and presses the side end in the width direction of the sheet with a constant force as illustrated in FIG. 7C. As a result, the sheet is caused to abut against the second side regulating plate 305 and thereby, the sheet can be stored at the position corresponding to the size of the sheet.

Figure 7D:
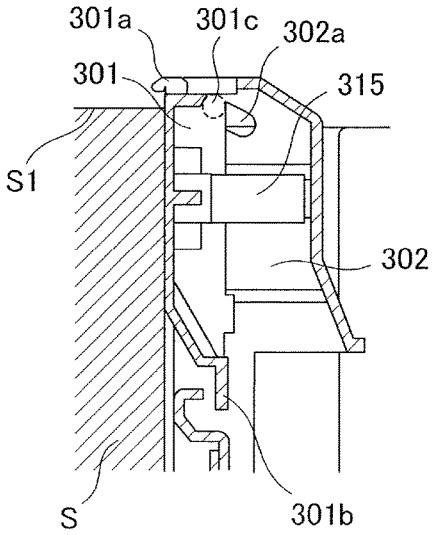
FIG. 7D illustrates a condition of the pressing member when the sheet is pressed against the pickup roller after the sheet feed cassette has been attached to the body of the image forming apparatus.

After that, the sheet supporting plate 309 rises and the sheet is pressed against the pickup roller after attaching the sheet feed cassette 300 in which the sheet has been stored to the image forming apparatus body 200A. At this time, as illustrated in FIG. 7D, a certain gap is kept between the uppermost sheet S1 and the height regulating portion 301*a* so that the height regulating portion 301*a* does not become feeding resistance in feeding the sheet by the pickup roller. Then, when a drive is transmitted from the image forming apparatus body 200A to the pickup roller in this condition, the sheet is fed out of the sheet feed cassette 300 without receiving any resistance from the height regulating portion 301*a*.

As described above, according to the present embodiment, the long holes 302*a* are defined aslant such that the downstream side in the retract direction is lowered. This arrangement makes it possible to efficiently transmit the pressing force of the sheet to the pressing member 301 and to move the pressing member 301 in the retract direction more smoothly when the pressing member 301 is pressed by the sheet to be stored. Still further, because the pressing member 301 is configured so as to move in the oblique direction, it is possible to shorten a length in the width direction of the first side regulating plate 303 and to downsize the first side regulating plate 303 and the sheet feed cassette 300.

Figure 8:
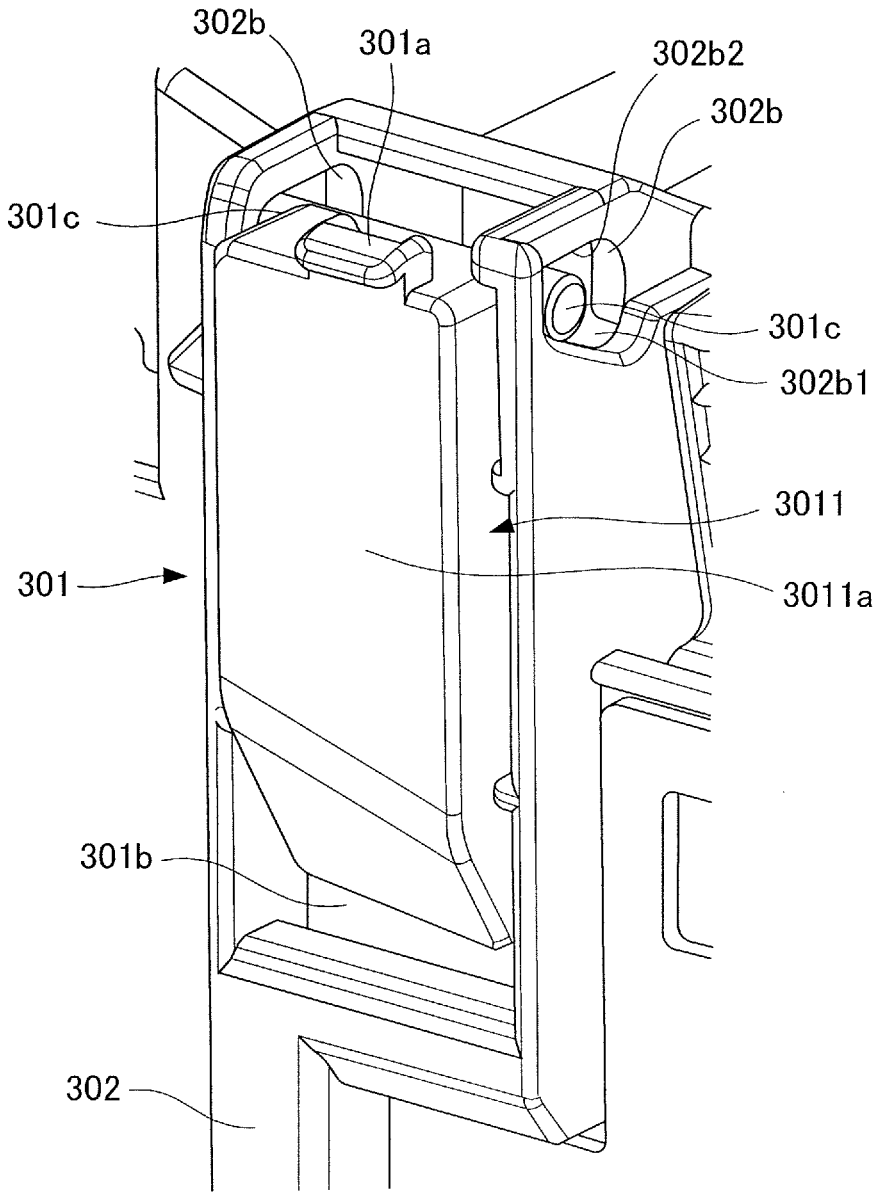
FIG. 8 is an enlarged perspective view of a main part of a first side regulating plate provided in the sheet feed cassette of the sheet feeding apparatus of a third embodiment.

Next, a third embodiment of the present disclosure will be described. FIG. 8 is an enlarged perspective view of a main part of a first side regulating plate provided in the sheet feed cassette of the sheet feeding apparatus of the present embodiment. It is noted that in FIG. 8, the same reference numerals with those described in FIG. 4 denote the same or corresponding components.

As illustrated in FIG. 8, the holder member 302 is provided with opening portions 302*b* defined through inner wall surfaces facing widthwise with each other and serving as support portions by which the bosses 301*c* of the pressing member 301 are movably supported. Each of the opening portions 302*b* includes a bottom surface 302*b*1 inclined obliquely downward. Thereby, the pressing member 301 is held turnably by the opening portions 302*b* and movably obliquely downward and upward along the bottom surface 302*b*1.

Figure 9A:
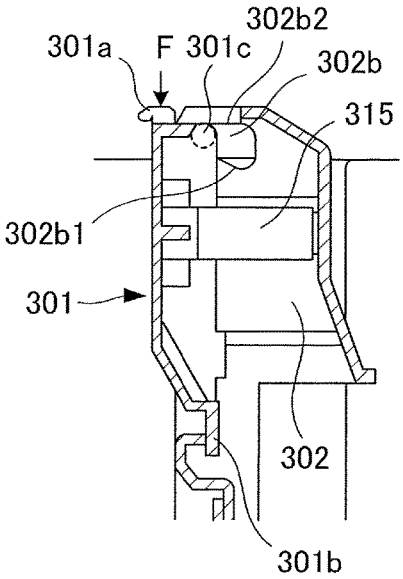
FIG. 9A illustrates a condition of a pressing member of the first side regulating plate before a sheet is stored in the sheet feed cassette.

Next, an operation of the pressing member 301 will be described with reference to FIGS. 9A through 9D. FIG. 9A illustrates a condition before a sheet is stored in the sheet feed cassette 300. At this time, by being urged by the urging member 315, the boss 301*c* of the pressing member 301 abuts against a downstream end in the projection direction of the opening portion 302*b* and the abutment portion 301*b* abuts against the first stopper 302*c*.

Figure 9B:
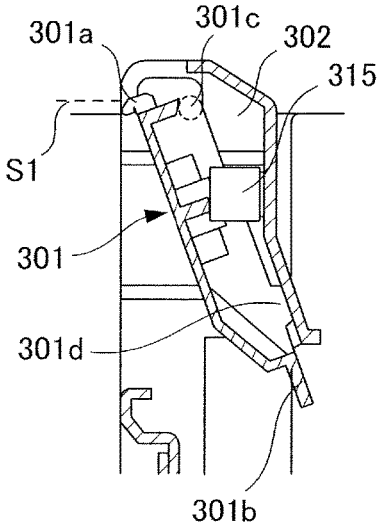
FIG. 9B illustrates a condition of the pressing member when the sheet is stored in the sheet feed cassette.

If the height regulating portion 301*a* receives a force F from the sheet stored in this condition, the pressing member 301 moves obliquely downward along the bottom surface 302*b*1 by a component of the force F while turning centering on the boss 301*c* as illustrated in FIG. 9B. Here, when the pressing member 301 moves thus obliquely downward, the pressing member 301 moves without being regulated in the vertical direction because there is a space x where the boss 301*c* is movable upward between a top surface 302*b*2 and the bottom surface 302*b*1 of the top surface 302*b*2.

Figure 9C:
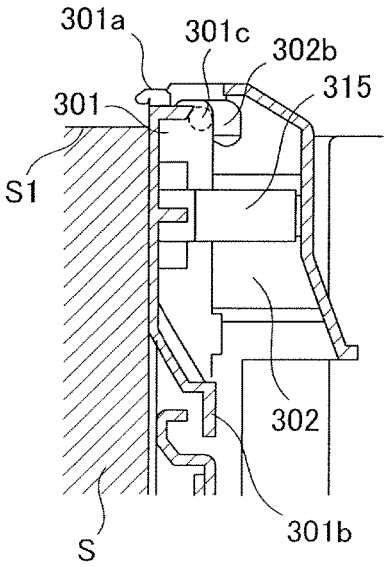
FIG. 9C illustrates a condition of the pressing member when the storage of the sheet is completed.

FIG. 9C illustrates a condition when the storage of the sheet is completed. At this time, no force is applied from above to the height regulating portion 301*a* by the sheet, so the pressing member 301 moves obliquely upward by the urging member 315 as illustrated in FIG. 9C and presses the side end in the width direction of the sheet with a constant force. As a result, the sheet is caused to abut against the second side regulating plate 305 and can be stored at a position corresponding to the size of the sheet.

Figure 9D:
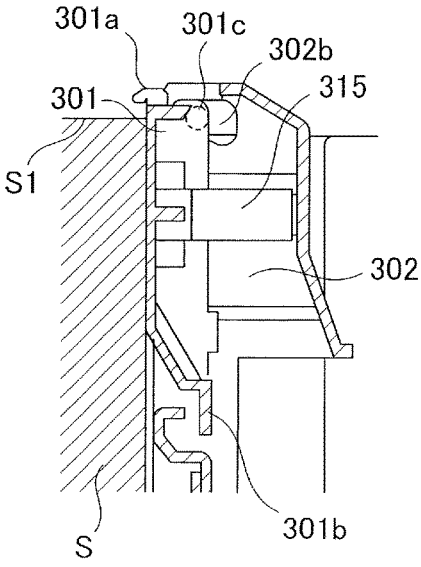
FIG. 9D illustrates a condition of the pressing member when the sheet is pressed against the pickup roller after the sheet feed cassette has been attached to the body of the image forming apparatus.

FIG. 9D illustrates a condition in which the sheet supporting plate 309 rises and the sheet is pressed against the pickup roller after attaching the sheet feed cassette 300 in which the sheet has been stored to the image forming apparatus body 200A. Here, a certain gap is kept between the uppermost sheet S1 and the height regulating portion 301*a* in order to prevent the height regulating portion 301*a* from becoming resistance in conveying the sheet by the pickup roller. Then, when a drive is transmitted from the image forming apparatus body 200A to the pickup roller in this condition, the sheet is fed out of the sheet feed cassette 300 without receiving any resistance from the height regulating portion 301*a*.

Here, an amount of the sheets that can be stored in the sheet feed cassette 300 will be described. According to the present embodiment, the sheets can be stored up to a position S1 illustrated in FIG. 9B. This position S1 can be determined whether or not the pressing member 301 can return to a position indicated in FIG. 9C without pressing the height regulating portion 301*a* by the end of the sheets S even in a case where the pressing member 301 retracts completely to a position indicated in FIG. 9C.

In FIG. 9B, height of the position of the height regulating portion 301*a* that has turned is approximately equal to height of the position of the uppermost sheet S1, and the pressing member 301 cannot return to the position indicated in FIG. 9C in this case. However, according to the present embodiment, because the pressing member 301 is configured such that the boss 301*c* can move upward due to the shape of the opening portion 302*b*, the pressing member 301 can move obliquely upward and can return to the position indicated in FIG. 9C when the pressing member 301 is urged by the urging member 315.

The position of the uppermost sheet S1 can be heightened and more sheets can be stored by holding the pressing member 301 by the opening portion 302*b* defined as described above in the present embodiment. It is noted that it is necessary to keep a certain gap between the uppermost sheet S1 and the height regulating portion 301*a* as described above in the condition of FIG. 9D. To that end, a sheet liftable amount of the sheet supporting plate 309 is set to be small as compared to those of the first and second embodiments. This arrangement makes it possible to feed and convey the sheet out of the sheet feed cassette 300 without changing the position of the uppermost sheet, i.e., a sheet feeding position, after lifting the sheet supporting plate 309.

As described above, according to the present embodiment, the more sheets can be stored by supporting the pressing member 301 by the opening portion 302*b* in which the space x enabling the boss 301*c* to move upward is defined between the bottom surface 302*b*1 and the top surface 302*b*2. Still further, in a case when a number of sheets to be stacked in the sheet feed cassette 300 is determined to be 500 sheets for example, the configuration of the present embodiment makes it possible to lower the height of the first side regulating plate 303 and to downsize the sheet feed cassette 300 in the vertical direction.

Figure 10:
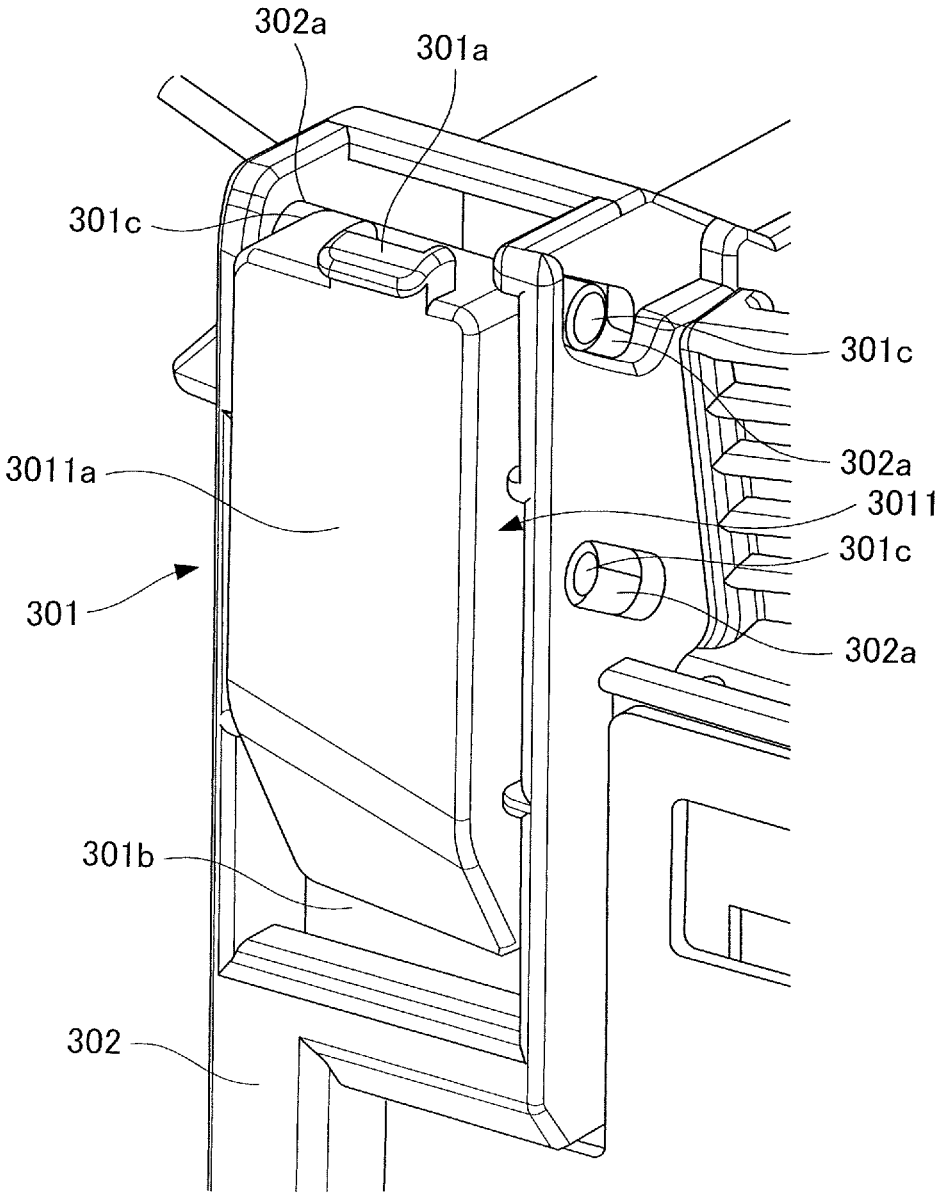
FIG. 10 is an enlarged perspective view of a main part of a first side regulating plate provided in the sheet feed cassette of the sheet feeding apparatus of a fourth embodiment.

Next, a fourth embodiment of the present disclosure will be described. FIG. 10 is an enlarged perspective view of a main part of a first side regulating plate provided in the sheet feed cassette of the sheet feeding apparatus of the present embodiment. It is noted that in FIG. 10, the same reference numerals with those described in FIG. 4 denote the same or corresponding components.

According to the present embodiment, two (plurality of) bosses 301*c* are arrayed in the vertical direction through both side wall surfaces in the width direction of the pressing member 301. Still further, two (plurality of) long holes 302*a* inclined such that the downstream side in the retract direction is lowered are defined in the vertical direction and in parallel through inner wall surfaces opposing in the width direction of the holder member 302. Then, the pressing member 301 is held by the holder member 302 movably while keeping the same attitude along the long holes 302*a* by slidably attaching the bosses 301*c* of the pressing member 301 respectively to the plurality of long holes 302*a*.

Figure 11A:
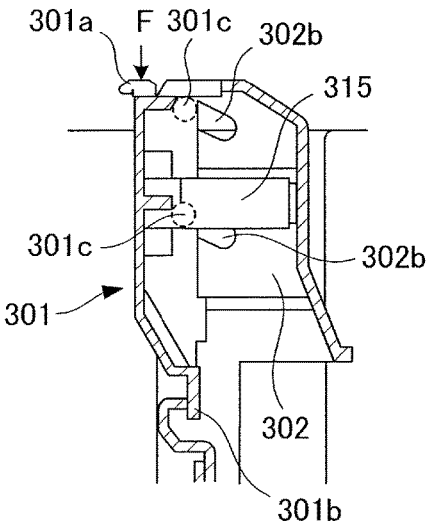
FIG. 11A illustrates a condition of a pressing member of the first side regulating plate before a sheet is stored in the sheet feed cassette.
Figure 11B:
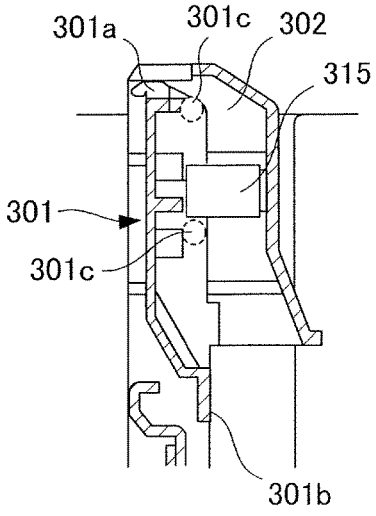
FIG. 11B illustrates a condition of the pressing member when the sheet is stored in the sheet feed cassette.

Thereby, as illustrated in FIG. 11A, when the height regulating portion 301*a* receives a force F from the sheet, the pressing member 301 moves obliquely downward while keeping the same attitude along the two long holes 302*a* by a component of the force F as illustrated in FIG. 11B. Then, the pressing member 301 moves until when the height regulating portion 301*a* enters within the holder member and becomes flush with the body portion 303*a* of the first side regulating plate 303.

Figure 11C:
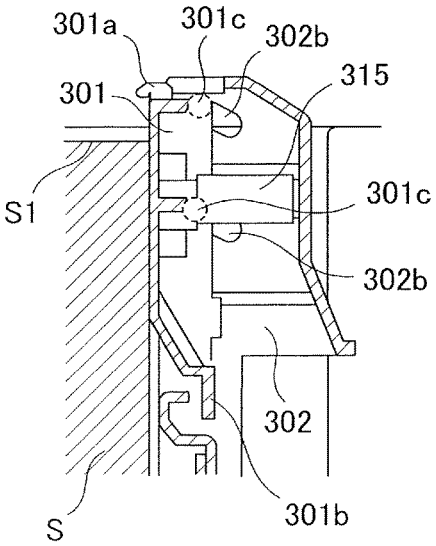
FIG. 11C illustrates a condition of the pressing member when the storage of the sheet is completed.

When the storage of the sheets is completed after that, no force is applied to the pressing member 301 from above by the sheets. Due to that, the pressing member 301 obliquely upward by the urging member 315 and presses the side end in the width direction of the sheet with a constant force as illustrated in FIG. 11C. As a result, the sheets are caused to abut against the second side regulating plate 305 and can be stored at the position corresponding to the size of the sheet.

Figure 11D:
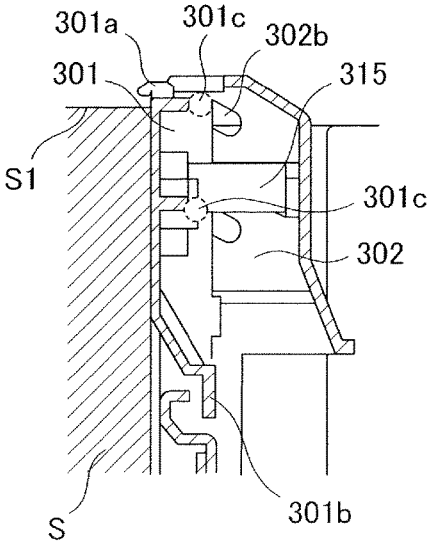
FIG. 11D illustrates a condition of the pressing member when the sheet is pressed against the pickup roller after the sheet feed cassette has been attached to the body of the image forming apparatus.

After that, the sheet supporting plate 309 rises and the sheets are pressed against the pickup roller after attaching the sheet feed cassette 300 in which the sheet has been stored to the image forming apparatus body 200A. At this time, as illustrated in FIG. 11D, a certain gap is kept between the uppermost sheet S1 and the height regulating portion 301*a* so that the height regulating portion 301*a* does not become the feeding resistance in feeding the sheet by the pickup roller. Then, when a drive is transmitted from the image forming apparatus body 200A to the pickup roller in this condition, the sheet is fed out of the sheet feed cassette 300 without receiving any resistance from the height regulating portion 301*a*.

As described above, because the two long holes 302*a* are defined in parallel and obliquely in the present embodiment, the pressing force of the sheet can be efficiently transmitted to the pressing member 301 in pressing the pressing member 301 from above by the sheets to be stored. This arrangement makes it possible to move the pressing member 301 smoothly in the retract direction. It is also possible to shorten the widthwise length of the first side regulating plate 303 and to downsize the sheet feed cassette 300 by causing the pressing member 301 to retract in the oblique direction. It is noted that although the long holes 302*a* obliquely defined are used as the support portion supporting the bosses 301*c* of the pressing member 301 in the present embodiment, the opening portion 302*b* of the third embodiment described above may be also used as the support portion.

Still further, although the configuration which enables the first and second side regulating plates 303 and 305 to move by operating the side regulation manipulating lever 312 has been described in the above descriptions, the present disclosure is not limited to such configuration. The present disclosure is also applicable to a configuration in which the first and second side regulating plates 303 and 305 are fixed like a sheet feed cassette 300 which corresponds only to a sheet whose widthwise size is constant. Still further, although the present disclosure has been applied to the first side regulating plate 303, it is possible to prevent the deterioration of the storability of the sheet even if the present disclosure is applied to the rear end regulating member 304.

Still further, while the pressing member 301 has been provided with the shaft and the holder member 302 has been provided with the support portion in the above description, the support portion may be provided in the pressing member 301 and the shaft may be provided in the holder member 302. That is, the boss 301*c* may be provided in one of the pressing member 301 and the holder member 302, and the long hole 302*a* or the opening portion 302*b* may be provided in the other one of the pressing member 301 and the holder member 302.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-014409, filed Jan. 28, 2016, which is hereby incorporated by reference herein in its entirety.

What is claimed is:

1. A sheet feeding apparatus comprising:

a sheet feed portion configured to feed a sheet; and a sheet storing apparatus configured to store the sheet to be fed by the sheet feed portion and comprising a sheet regulating portion regulating a position of the sheet by abutting with an edge of the sheet stored in the sheet storing apparatus, the sheet regulating portion comprising:

a body portion comprising a regulating surface facing the edge of the sheet to regulate the edge of the sheet;

a pressing member comprising a pressing portion capable of projecting out of the body portion and of pressing the sheet, and an upper portion formed integrally with an upper part of the pressing portion so as to project to a sheet side and regulating an upward move of the sheet stored in the sheet storing apparatus;

an urging member configured to urge the pressing member such that the pressing member projects out of the body portion so that the pressing portion presses the edge of the sheet; and a holding portion configured to hold the pressing portion movably from a projecting position where the pressing portion projects out of the body portion to a retracting position where the upper portion enters within the body portion while inclining the pressing portion with respect to the regulating surface by resisting against the urging member when the upper portion is pressed from above.

2. The sheet feeding apparatus according to claim 1, wherein a supported portion is provided in one of the holding portion and the pressing portion, and wherein a support portion supports the supported portion such that the pressing portion is movable to the projecting position and the retracting position and is provided in the other of the holding portion and the pressing portion.

3. The sheet feeding apparatus according to claim 2, wherein the supported portion is a shaft, and wherein the pressing member turns centering on the shaft when the upper portion is pressed from above and moves, while turning, to the projecting position and the retracting position.

4. The sheet feeding apparatus according to claim 3, wherein the support portion is a long hole extending in a horizontal direction.

5. The sheet feeding apparatus according to claim 3, wherein the support portion is a long hole inclined such that a height position of the pressing member is lowered when the pressing member moves to the retracting position.

6. The sheet feeding apparatus according to claim 3, wherein the support portion is an opening portion comprising a bottom surface inclined such that a height position of the pressing portion is lowered when the pressing member moves to the retracting position and defining a space in which the shaft can move upward between the bottom surface and a top surface.

7. An image forming apparatus comprising:

an image forming unit configured to form an image on a sheet; and a sheet feeding apparatus according to claim 1 configured to feed the sheet to the image forming unit.

8. A sheet storing apparatus comprising:

a body configured to store a sheet; and a sheet regulating portion configured to abut against an edge of the stored sheet to regulate a position of the sheet, the sheet regulating portion comprising:

a body portion comprising a regulating surface facing the edge of the sheet to regulate the edge of the sheet;

a pressing member comprising a pressing portion projectable/retractable from the body portion and capable of pressing the edge of the sheet, and an upper portion formed integrally with an upper part of the pressing portion so as to project to a widthwise inner side and regulating an upward move of the sheet stored in the sheet storing apparatus;

an urging member configured to urge the pressing member such that the pressing member projects out of the body portion so that the pressing portion presses the edge of the sheet; and a holding portion configured to hold the pressing member movably from a projecting position where the pressing portion projects out of the body portion to a retracting position where the upper portion enters within the body portion by resisting against the urging member when the upper portion is pressed from above.

9. The sheet storing apparatus according to claim 8, wherein the pressing member comprises a shaft, and a long hole is configured to engage with the shaft of the pressing member and to guide the pressing member movably in a width direction between the projecting position and the retracting position.

10. The sheet storing apparatus according to claim 9, wherein the holding portion is provided with the long hole such that the shaft of the pressing member is turnable.

11. The sheet storing apparatus according to claim 10, wherein the shaft of the pressing member is located under and widthwise outside of the upper portion, and wherein the urging member is configured to urge the pressing member to widthwise inside at a position lower than the shaft of the pressing member.

12. The sheet storing apparatus according to claim 9, wherein the holding portion is provided with the long hole such that the retracting position is lower than the project position.

13. The sheet storing apparatus according to claim 9, wherein the shaft is one of plurality of shafts provided vertically, and wherein the long hole is one of plurality of long holes provided vertically and in parallel with each other.

14. The sheet storing apparatus according to claim 8, wherein the holding portion is configured to hold the pressing portion movably from the projecting position to the retracting position while inclining with respect to the upper portion.

15. An image forming apparatus, comprising:

an image forming unit configured to form an image on a sheet;

a sheet feeding apparatus configured to feed the sheet to the image forming unit; and a sheet storing apparatus as set forth in claim 8 configured to store the sheet to be fed by the sheet feeding apparatus.

* * * * *